United States Patent [19]

Fujita

[11] 4,406,727

[45] Sep. 27, 1983

[54] MANUALLY-OPERATED LABELER

[75] Inventor: Mituo Fujita, Sakatoshi, Japan

[73] Assignee: Kabushiki Kaisha Shinsei Industries, Tokyo, Japan

[21] Appl. No.: 312,343

[22] Filed: Oct. 16, 1981

[30] Foreign Application Priority Data

Oct. 24, 1980 [JP] Japan ..... 55-148406
Jun. 12, 1981 [JP] Japan ..... 56-90518

[51] Int. Cl.[3] ..... B65C 11/02

[52] U.S. Cl. ..... 156/384; 101/288; 101/291; 156/577; 156/579; 156/584; 156/DIG. 49

[58] Field of Search ..... 156/384, 577, 579, DIG. 49, 156/584; 101/288, 291, 295

[56] References Cited

U.S. PATENT DOCUMENTS 4,113,544 9/1978 Sato ..... 156/384
4,176,603 12/1979 Sato ..... 156/384
4,204,902 5/1980 Hamisch, Jr. ..... 156/384
4,267,006 5/1981 Karn et al. ..... 156/384

*Primary Examiner*—Michael G. Wityshyn
*Attorney, Agent, or Firm*—Wenderoth, Lind & Ponack

[57] ABSTRACT

A manually-operated labeler for dispensing labels from a carrier strip having labels stuck onto the carrier strip. The labeler has a casing in which there is a carrier strip feeding mechanism driven by an actuating mechanism for advancing the carrier strip and turning it back at a turnback part to separate a label from the carrier strip. A printing device is provided which moves toward the turnback part for printing a label which is passing thereover on the carrier strip.

The handle extended from said case is opposed to a lever provided as a part of the actuating mechanism and a checking device is dividedly provided on the lever and the handle to generate a signal when the lever approaches the handle. The printing device performs a rocking motion with a guide. The ink supplying device opposing the printing device has an ink roller arranged on the cover of the case. The feed drum of the carrier strip feeding mechanism is rotated by a feed drive mechanism provided on the actuating mechanism regardless of the operation of the lever.

6 Claims, 14 Drawing Figures

MANUALLY-OPERATED LABELER

BACKGROUND OF THE INVENTION

The present invention relates to a manually-operated labeler in which a carrier strip turned back at the carrier strip turnback part is intermittently fed by a swinging operation of the manual lever and a label stuck on the carrier strip is separated from said carrier strip and forwarded to be dispensed.

The conventional types of this labeler are disadvantageous in that the printing device is pushed to print a label by the lever and therefore the clearness of the printout on the label differs with the magnitude of the force the operator applies to the lever.

Such difference of the clearness of the printout is not inconvenient for general labels which show only the prices; however the symbolic codes such as bar codes for a computer have been printed on recently used labels and clear printing is therefore required for the labels to be used for such purpose.

Moreover the commodity prices and the bar codes can be printed simultaneously on the labels and the printing device can thus include two or three printing mechanisms, and accordingly the stroke of movement of the ink roller must be made long.

An object of the present invention is to provide a labeler provided with a checking device which generates a check signal when the lever is turned as far as necessary to the handle side of the case. This construction permits elimination of the difference of clearness of the printout on the labels by applying a specified force.

Another object of the present invention is to provide a labeler in which the feed drum is rotated by shifting the position of a rack gear which is provided on the operating part of the actuating mechanism to drive the feed drum regardless of the operation of the lever, or the timing of starting the first rotation of the feed drum is delayed, thus enabling it to accurately control the position of the label to be printed by the printing device.

Still another object of the present invention is to provide a labeler in which the printing device is forced to perform a rocking motion to extend a relative sliding stroke of the ink roller for the printing device when the printing device is caused to approach a lable to be printed and a single ink roller can roll over a plurality of printing mechanisms.

Still another object of the present invention is to provide a labeler wherein the printing belt supporting mechanism of the printing mechanism is rockable so that the type faces of the printing mechanism closely contact the label.

Still another object of the present invention is to provide a labeler in which the label receiving part for supporting a label under the printing mechanism is made of an elastic sheet material which can be deformed at the impression point of each type element of said printing mechanism.

SUMMARY OF THE INVENTION

The present invention provides a manually-operated labeler comprising a case which has an extended handle and a label tape holding part which holds a label tape wound in the form of roll, an actuating mechanism which is secured to said case and has a lever, which opposes said handle and is urged away from the handle by a resetting spring, and an operating part which is formed at the internal end of said lever located inside said case, a feed drive mechanism such as, for example, a rack gear which is provided on said operating mechanism, a carrier strip feeding mechanism such as, for example, a feed drum mechanism which is driven by said feed drive mechanism to intermittently feed a carrier strip of the label tape a fixed length, a carrier strip turnback part which turns back said carrier strip and separates and forwards a label from the carrier strip when the carrier strip advances, a printing device which prints on a label stuck on said carrier strip at a position before said carrier strip turnback part, and a checking device which comprises a check signal generating part having, for example, a buzzer which is provided on one of the handle and the lever of said case and an actuating means which is provided on the other, wherein the actuating means of said checking device is adapted to drive said check signal generating part when said lever is pivoted a certain distance toward said handle so that said printing device performs an impression on the label along with pivotal movement of said lever toward said handle and said feed drive mechanism drives said carrier strip feeding mechanism during the resetting motion of said lever to feed the carrier strip of said label tape.

Said printing device is pivoted to said operating part and provided an the opposing ink roller which rolls over the type elements of the printing device during printing motion of the printing device. Said ink roller is always kept in contact with the type elements by a spring and is swung outside the printing device when the printing device is lowered while the printing device is rocked in an opposite direction to the ink roller by the guide means. Said printing device contains at least one printing mechanism which has a plurality of printing belts and the printing belt supporting mechanism to support the rear sides of printing belts which face the type elements. Said printing belt supporting mechanism has a supporting case which is pivotable in the direction of arrangement of the type elements around a point as the fulcrum. The array of type elements is moved by rocking motion of this supporting case to closely contact the label.

Said ink roller is provided inside the cover which forms the front part of said case and said cover is pivoted at its upper end to the case, and the ink roller can be pulled outside the case after pivoting the cover.

Said carrier strip turnback part has a label receiving part which is made of an elastic sheet material to support the label. Said elastic sheet material is provided with an array of elastic projections on the rear side of the label receiving surface so that these projections are depressed by each type element of said printing mechanism, and the label receiving surface is deformed to come in close contact with the type elements.

The operating part of said actuating mechanism is provided with a rack gear which engages with a one-way clutch of the feed drum of the carrier strip feeding mechanism. Said rack gear is moved regardless of the movement of the lever to cause the feed drum to be rotated in the feed direction or to delay the first engagement of the one-way clutch with the feed drum, thus adjusting the position of the label to be printed.

BRIEF DESCRIPTION OF THE DRAWINGS

FIG. 7A shows a position of a type element ready for a printing operation and FIG. 7B shows the next type element being positioned.

DETAILED DESCRIPTION OF THE INVENTION

Figure 1:
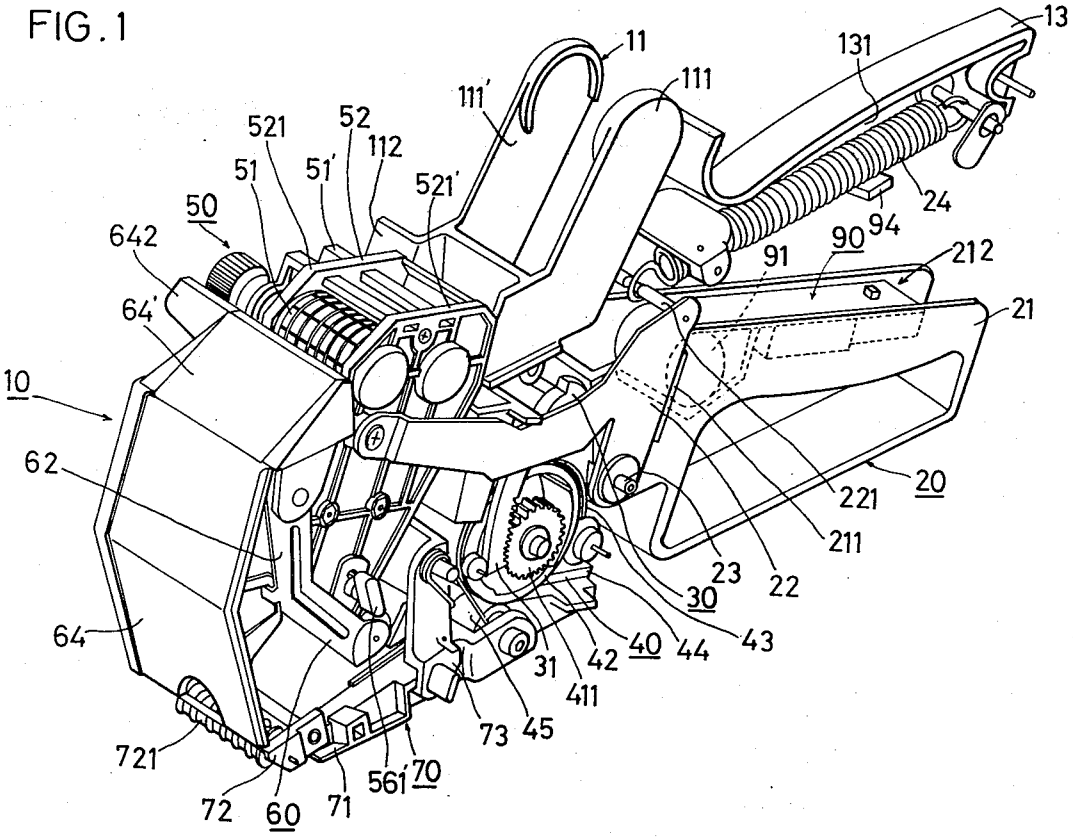
FIG. 1 is a perspective view of the labeler in accordance with the present invention.

Referring to FIG. 1, there is shown a manually-operated labeler according to the present invention, comprising case 10, actuating mechanism 20, feed drive mechanism 30, carrier strip feeding mechanism 40, printing device 50, ink applying device 60, label separating mechanism 70, label carrier strip (hereinafter referred to as "label tape") 80 and checking device 90.

Said case 10 includes a holding part 11 for the label tape 80, the main part 12 which contains said carrier strip feeding mechanism 40 and the printing device 50, and a handle 13 which is extended from said main part 12.

Said holding part 11 is constructed, as shown in FIG. 1, to hold the label tape 80 which is coiled in the form of a roll between a pair of resilient members 111 and 111′ and a projection 112 which projects outwardly farther than the dial is provided on the dial side of the printing device 50 which is described later.

Said resilient members 111 and 111′ are fixed to the main part 12 of the case to support the label tape 80 so that it will not come off.

An internal chamber 131 which is open to the lower side as shown in FIG. 1 is formed in said handle 13 and a lever 21 of said actuating mechanism 20 is opposed to said internal chamber 131.

Said actuating mechanism 20 is provided with the lever 21 the inner end of which is pivotally secured to the main part 12 and the external free end swings toward and away from the handle 13, and an operating part 22 which is coupled to the inside part of said lever 21 and performs swinging movement. Said lever 21 and operating part 22 are pivotally secured to the main part 12 by the same pivot 23 and the lever 21 is always urged away from the handle 13 by the resetting spring 24 mounted between said operating part 22 and said handle 13.

The lever 21 and the operating part 22 can be integrally constructed to ensure collaboration of these parts. In the embodiment of the present invention, since the lever 21 is made of a material different from the operating part 22, a receiving part 211 for supporting the operating part 22 is provided on the lever 21 which is separately made and the lever 21 and the operating part 22 are secured by means of a bushing, and a support shaft 221 is provided on the operating part 22 to which one end of the spring 24 is hooked so that the operating part 22 is depressed against said receiving part 211 by the action of the spring 24.

Figure 3:
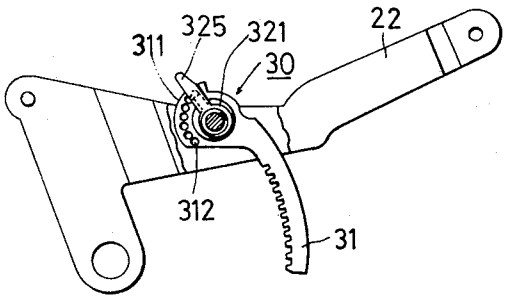
FIG. 3 is a partly cut away side view of the feed drive mechanism.
Figure 4:
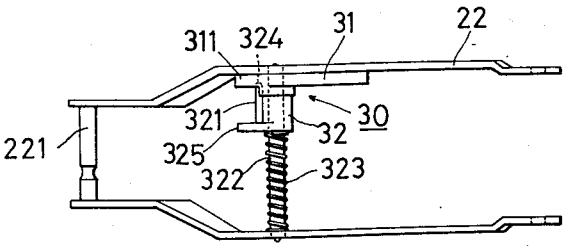
FIG. 4 is a plan view of said feed drive mechanism.

Said feed drive mechanism 30, as shown in FIGS. 3 and 4, is provided with a rack gear 31 which is rotatably provided on said operating part 22 and an adjusting means 32 is provided which adjusts the position of said rack gear 31, the position of said rack gear 31 on the operating part 22 can be shifted by the rotation of the rotary member 321 provided on the rack gear 31 in the direction of the width of the operating part 22, that is, in the vertical direction in FIG. 3.

The mechanism of said adjusting means 32 in the embodiment has the rotary member 321 closely fitted into a pivot hole which is formed in the rack gear 31 and the rotary member 321 is pivotally eccentrically on the operating part 22 on the support shaft 322, and said rotary member 321 is provided with the spring 323 which urges the rotary member 321 against the rack gear 31 and is provided with an engaging part such as, for example, the engaging claw 324 which engages with the rack gear 31. A plate 311 is formed on the pivot side of the rack gear 31 and provided with a number of engaging holes 312 for engagement with said engaging claw 324.

In the above embodiment, if the lug 325 provided on the rotary member 321 is moved by fingers to rotate the rotary member 321 away from the rack gear 31 against the force of spring 323 and the rotary member 321 is rotated, the rack gear 31 is shifted in accordance with the rotation of the rotary member 321 and fixed at the shifted position when the claw 324 on the rotary member 321 is engaged again with a hole 312 in the rack gear 31.

Though the distance of said rack gear 31 is shifted is determined by the eccentricity of the rotary member 321, the rotary member 321 can generally have a small diameter since the amount of positional adjustment of the lable is extremely small.

The rack gear 31 engages with the mating gear 411 of the one-way clutch 41 of said carrier strip feeding mechanism 40 to drive said one-way clutch. Where the direction of rotation of the mating gear 411 is the same as the direction of engagement of the one-way clutch, that is, the label tape feed direction, the label tape slightly advances and, where the direction of rotation of the mating gear 411 is opposite to the direction of disengagement of the one-way clutch, that is, the opposite direction to the label tape feed direction, the one-way clutch slightly delays in its first engagement after adjustment and the initial feed length of the label tape is slightly reduced. Accordingly, the position of the label opposite to said printing device can be finely adjusted by said adjusting means 32.

Said carrier strip feeding mechanism 40 which intermittently feeds said label tape 80 is driven by said rack gear 31 which is mounted on the operating part 22 of said actuating mechanism 20 and provided with said one-way clutch 41 which is rotated in the feed direction of the label tape 80 by the rack gear 31 while the lever 21 performs the resetting motion and the feed drum 42 which is coupled to and rotated by this one-way clutch 41. Said feed drum 42 is provided with engaging projections on its outer periphery which engages with the feed holes perforated in the carrier strip 81 which constitutes the label tape 80.

Said carrier strip feeding mechanism 40 is provided with a guide 43 opposed to the feed drum 42 with a clearance 43', therebetween, a cutter 44 for cutting the carrier strip 81 which is discharged from the feed drum 42, and a feed roller 45 which is pressed against the feed drum 42 to feed the carrier strip 81.

Said guide 43 is a plate which is formed in a circular shape along the feed drum 42 to form the guide clearance 43' for guiding the carrier strip along the outside of the feed drum 42. When the carrier strip 81 is inserted into this guide clearance 43' between the feed drum 42 and the feed roller 45 and the lever 21 is reciprocated to rotate the feed drum 42, the carrier strip 81 will be automatically forwarded to the cutter 44 and therefore manual mounting of the carrier strip 81 on the feed drum 42 is unnecessary.

Said label tape 80 comprises a number of labels 82 on the rear surfaces of which an adhesive layer is formed and the carrier strip 81 made of a non-adhesive material onto which said labels 82 are stuck in consecutive order.

Said printing device 50 is mounted on the operating part 22 of said actuating mechanism 20 and incorporates a plurality of printing devices, for example, in this embodiment, two printing mechanisms 51 and 51' so that two rows of characters can be simultaneously printed on each label 82. Said printing mechanisms 51 and 51' are at a slight angle to each other and constructed so that the lower printing ends are arranged close to each other while the upper ends are spaced from one another so that the dials thereon can be operated.

Since these printing mechanisms 51 and 51' have the same construction, the following describes only the printing mechanism 51 and omits the description of the printing mechanism 51'.

Figure 5:
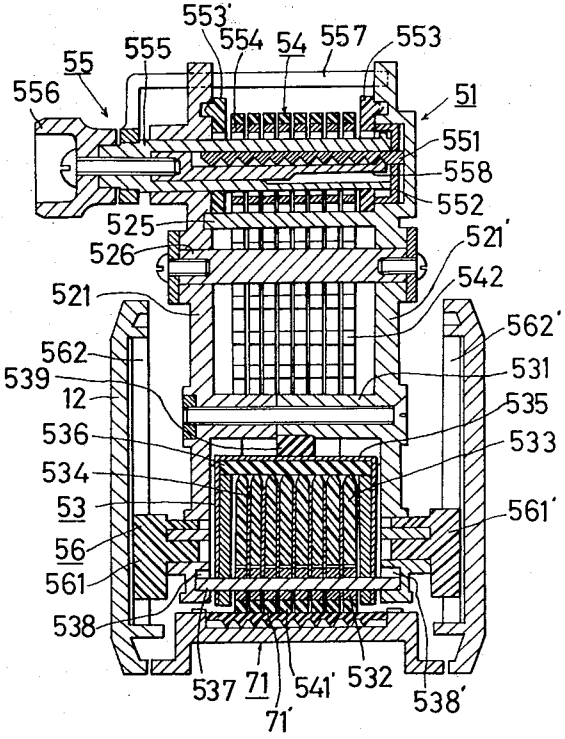
FIG. 5 is a cross sectional view of the printing device employed in the labeler of the present invention when engaged with the label receiving surface.
Figure 6:
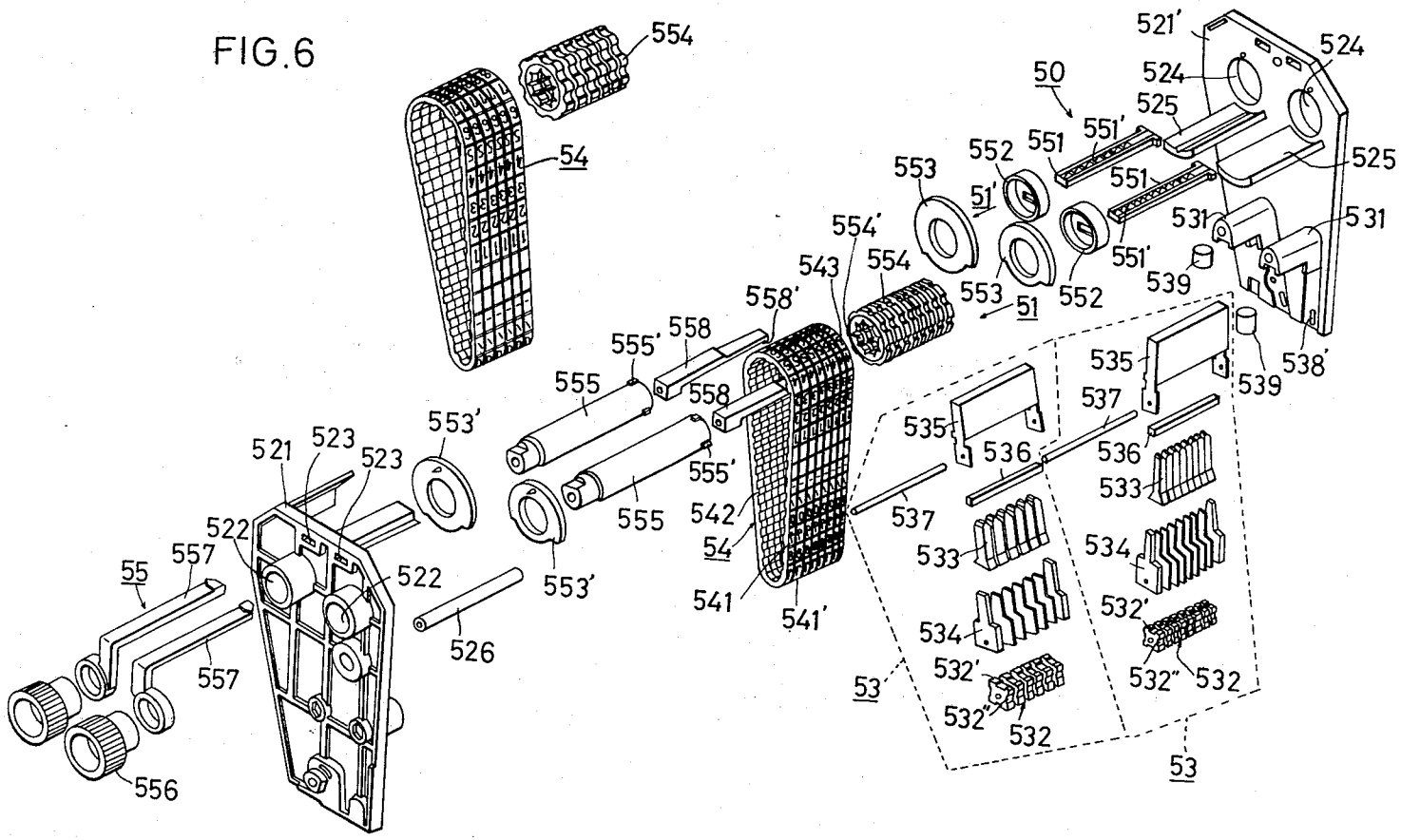
FIG. 6 is a disassembled perspective view of said printing device.

Said printing device 50, as shown in FIGS. 5 and 6, has a mounting frame 52 which is secured on said operating part 22 and carries the two printing mechanisms 51 and 51' as shown in FIG. 1, and this mounting frame 52 consists of a pair of frame plates 521 and 521' which are opposed to each other.

Said frame plate 521 is provided with two through holes 522 and indicator inlet through holes 523 are provided adjacent to the through holes 522 at its upper part.

Said frame plate 521' has recessed receiving parts 524 which are opposed to each through hole 522 at the upper part of the opposing frame plate 521 and receiving members 525 for receiving the rotary disks and which extend toward the frame plate 521 are provided beneath each receiving part 524.

At least one coupling shaft 526 is horizontally provided between said frame plates 521 and 521' to fix the pair of opposing frame plates 521 and 521'.

A printing belt supporting mechanism 53 is provided for each printing mechanism between said pair of frame plates 521 and 521'.

This printing belt supporting mechanism 53 is provided with rotary cams 532 which are provided below brackets 531, pushing bars 533 which support these rotary cams 532, spacers 534 which individually separate said rotary cams 532 and said pushing bars 533 from other rotary cams 532 and pushing bars 533, support case 535 which supports said pushing bars 533, resilient members 536 which are housed in this support case 535 and against which the upper ends of said pushing bars 533 bear, support shaft 537 on which said rotary cams 532 are mounted in said support case 535 and which has the opposite ends projecting from the support case 535, long grooves 538 and 538' provided respectively, for example, at the lower end parts of said frame plates 521 and 521' in which said support shaft 537 bears, and fulcrum block 539, for example, block member made of a resilient material which is arranged between said bracket 531 and said support case 535 and contacts the center top of the support case 535. The number of rotary cams 532 is equal to the number of printing belts 54.

Generally, said brackets 531 project from the internal walls of said frame plates 521 and 521'. In the embodiment, cylindrical brackets 531 are provided in parallel on each of internal walls of the frame plates 521 and 521', respectively and joined when the frame plates 521 and 521' are fitted into the assembly.

Said rotary cams 532 are arranged in a row corresponding to the set of printing belts 54 and a printing belt 54 is mounted on each rotary cam 532 and separated from adjacent belts by the spacers 534 so that said rotary cams 532 and printing belts 54 can be individually rotated, and the bearing surfaces 532' of said rotary cams 532 are formed to closely contact the rear surfaces of the type elements 541 of the printing belts 54. In the embodiment, each rotary cam 532 is made in the form of regular square to provide four bearing surfaces 532' in which the grooves 532'' are provided to engage a corresponding projection 542 on the rear surface of the printing belt 54.

Figure 7:
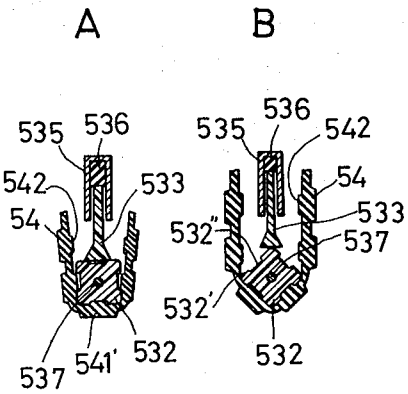
FIGS. 7A and 7B are cross sectional side views of a principal part illustrating the operation of the printing belt supporting mechanism of said printing device.

Each pushing bar 533 is adapted to contact at all times the bearing surface 532' of the corresponding rotary cam 532 to prevent spontaneous rotation of the rotary cam 532 as shown in FIG. 7A, and it is pushed up by the corresponding rotary cam 532, to permit rotation of each rotary cam 532 as shown in FIG. 7B, when a selected printing belt 54 is moved and is retracted into the support case 535 against the depressing force of said resilient member 536.

Said support case 535 is supported at its center top by said fulcrum member 539 and at both lower ends by said long grooves 538. Usually, as shown in FIG. 5, the support case 535 is set so that said support shaft 537 is engaged in the lower ends of the long grooves 538 and 538' as shown in FIG. 5.

Accordingly, in case of the printing belt supporting mechanism, both ends of the support case 535 can be moved vertically a distance equal to the length of the long grooves 538 and 538' around the fulcrum member 539 as the fulcrum and therefore, although the printing faces of the set of printing belts 54 are skewed against the surface of the label 82, such deviation can be absorbed by a rocking motion of the support case 535 and the unevenness of the surface of label 82 is offset by the rotary cams 532 since the rotary cams 532 are resiliently held by the resilient member 536.

Accordingly, the printing faces of the type elements on the set of printing belts 54 can be caused to closely and accurately contact the surface of each label 82.

The support case 535 can be swung by another construction. For example, guide pins can be inserted from both frame plate sides into long grooves which are respectively provided on the sides of the support case 535 which closely face the frame plates 521 and 521'. And said fulcrum member 539 can be integrally formed with the top of the support case 535.

The printing belt drive mechanism 55 is located between said frame plates 521 and 521' for each printing mechanism 51 or 51'. This printing belt drive mechanism 55 is provided with an engaging element 551 which is inserted into said receiving part 524 and which has a serrated engaging surface 551' which is parallel with said bracket 531, a fixing member 552 through which said engaging element 551 is inserted with the root of the engaging element 551 being secured in the receiving part 524, spacers 553 and 553' which isolate said printing belts 54 from the frame plates 521 and 521', rotary disks 554 which are provided for each of the printing belts 54, the printing belts being mounted on said rotary disks 554, selector shaft 555 which rotatably supports the rotary disks 554 and has one end which extends through the insertion hole 522, knob 556 mounted on the end of the selector shaft 555, indicator 557 one end of which is held between said selector shaft 555 and said knob 556 to move along with the reciprocation of said selector shaft 555 in the axial direction and is inserted in parallel to the selector shaft 555 through the insertion hole 523 into the mounting frame 52, and engaging bar 558 provided in said selector shaft 555.

Said selector shaft 555 is provided with engaging projection 555' at one end by which the rotary disks 554 are selectively engaged for movement in the direction of rotation.

For such engagement, the rotary disks 554 are respectively provided at their centers with the through holes into which said selector shaft 555 is inserted, and engaging grooves 554' are provided in the radial walls of each through hole.

Each printing belt 54 is provided with a number of type elements 541 such as, for example, numerals, symbols and bar codes and corresponding readable characters 543 in order. The arrangement of the type elements 541 on the printing face of the printing mechanism 51, that is, the arrangement of type elements under the rotary cams 532 are indicated by the characters 543 adjacent the indicator 557.

Said engaging bar 558 is fixed in the hollow chamber provided in said selector shaft 555.

This hollow chamber of the selector shaft 555, as shown in FIG. 5, is open toward the frame plate 521' and contains the engaging surface 551' of said engaging element 551. The engaging end 558' of the engaging bar 558 engages with the serrations on the engaging surface 551' from beneath to permit snapping motion of the selector shaft 555 and positioning of the selector shaft 555 so that the engaging projection 555' on the selector shaft 555 is accurately engaged in the engaging grooves 554' of the selected rotary disk 554.

Said printing device 50 is provided with guide means 56 which controls vertical movement of the mounting frame 52 and comprises projecting pieces 561 and 561' which are mounted rotatably, for example, on the mounting frame 52 and straight channels 562 and 562' which are provided on the opposing inside faces of the case 10 to accommodate these projecting pieces 561 and 561' and which are angled downwardly and toward the pivot shaft 23 for operating part 22.

Accordingly, in this embodiment, the position of the printing device 50 is changed by movement along the guide means 56 during rotation of the operating part 22.

The printing device 50 is pivotally secured on the operating part 22 so that the upper part is moved forwardly while its lower part is guided rearwardly by the rotatable projecting pieces 561 and 561' moving in the channels 562 and 562' along a path inside an arc along which the lower part would move if unguided, so that and the printing device 50 rocks so as to come in contact the label receiving surface 71' of the label separating mechanism 70 while being vertically moved by the pivotal motion of the operating part 22. Said printing mechanisms 51 and 51' need not be constructed as shown in the embodiment. For example, porous type elements which contain an ink can be employed.

In such a case, since the type elements are stamp type elements in which the ink is contained, therefore an ink applying device 60 is not required.

Figure 8:
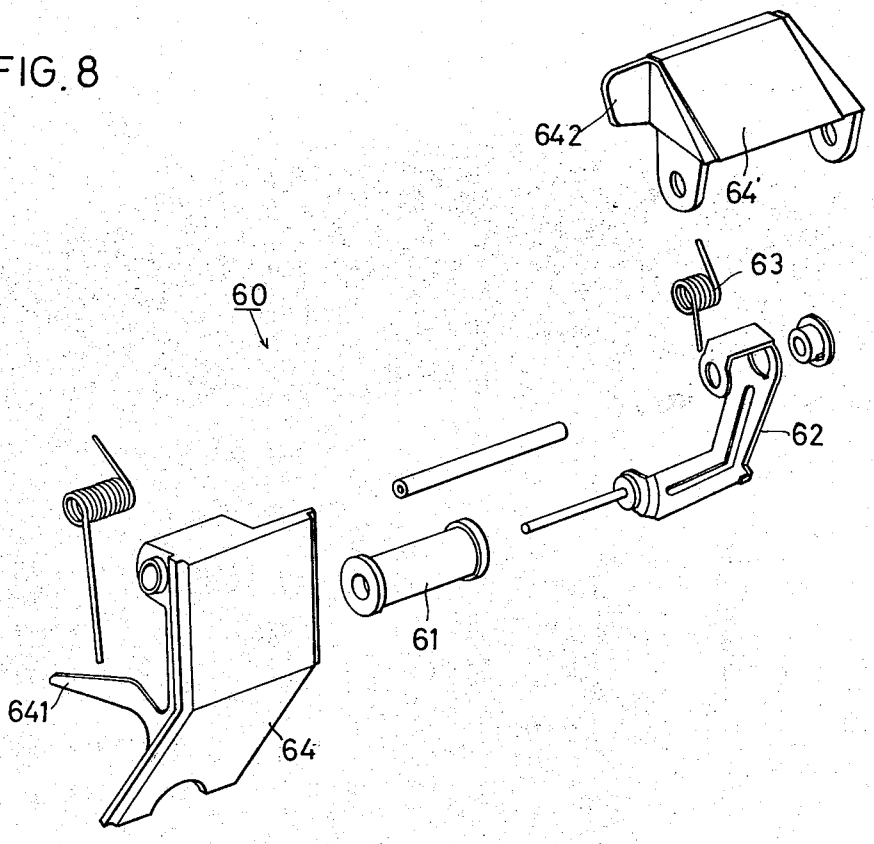
FIG. 8 is a disassembled perspective view of the ink applying device employed in the labeler of the present invention.

Said ink applying device 60 serves to apply ink to the type elements 541 on the underside of the printing device 50 and is provided with the ink roller 61 which is impregnated with ink as shown in FIG. 8, a swing arm 62 one end of which is connected to the ink roller 61 and the other end is pivoted to the case 10 and spring means 63 which forces the swing arm 62 to press the ink roller 61 onto the type elements most remote from the pivot point of the swing arm 62, that is, the type elements of the printing mechanism 51' in the embodiment. In the embodiment, this swing arm 62 is mounted on the cover 64 so that the ink roller 61 can be drawn out of the case 10 as shown by the broken line in FIG. 2. Such construction is advantageous in that the replacement of the ink roller 61 and the inspection of the case interior can be easily carried out.

The cover 64 is provided with an aligner 641 so that the ink roller 61 does not come off in the case 10 and the ink roller 61 is held at its end by this aligner 641.

This ink roller 61 is pushed by the printing device 50 and retracts when the printing device 50 is lowered and is reset by the force of the spring means 63 when the printing device 50 is lifted as in case of the conventional labeler. In this embodiment, it is advantageous in that, since the printing device 50 performs a deflection motion in an opposite direction to the direction of deflection of the ink roller 61, the stroke of the ink roller 61 relative to the printing device 50 is increased due to the combined effect of such deflecting motion of the printing device 50 and the deflecting motion of the ink roller 61, and therefore the ink roller 61 can roll along all type elements 541 of the printing mechanisms 51 and 51' even though a plurality of the printing mechanisms are mounted on the printing device 50 as shown in the embodiment.

In the embodiment, said ink applying device 60 is provided on the cover plate 64' which is provided with an extension lug 642 opposed to the projection 112 of said holding part 11. The knobs 556 of said printing device 50 are positioned between the projection 112 and the extension lug 642 so that the knobs 556 are protected from a damage due to an impact with other objects.

Figure 2:
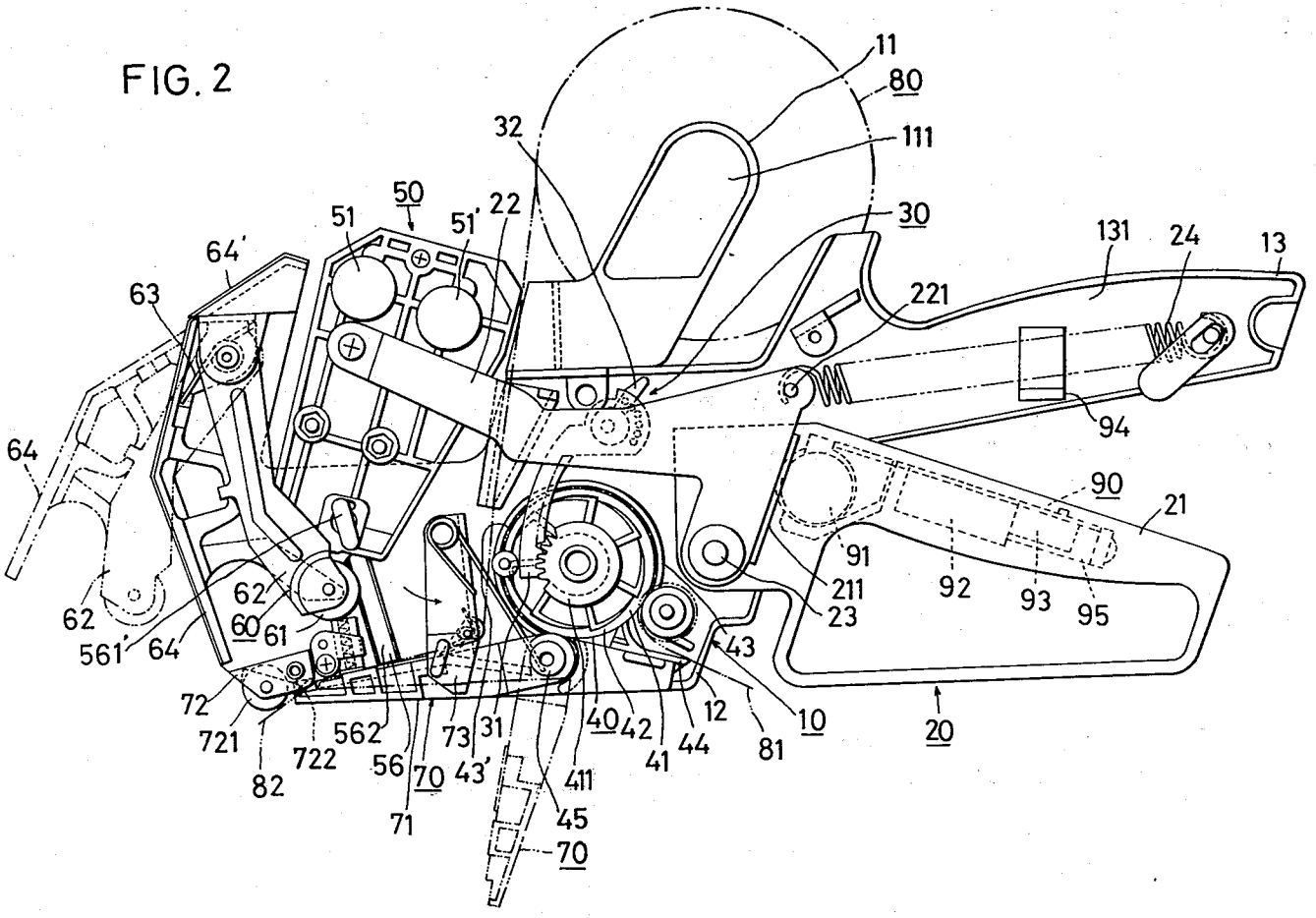
FIG. 2 is a side view showing the interior of said labeler.

Said label separating mechanism 70, as shown in FIG. 2, comprises a receiving frame 71 which can be swung outwardly, a holding member 72 opposed to this receiving frame 71 and a guide frame 73 which guides the label tape 80 to the label receiving surface 71' of said receiving frame 71 and engages with the receiving frame 71.

Figure 9:
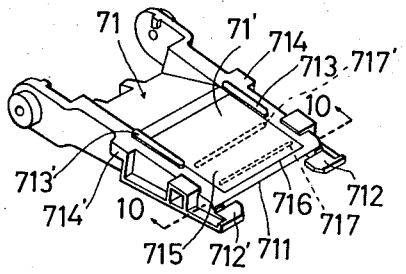
FIG. 9 is a perspective view of the receiving frame of the label separating mechanism employed in the labeler of the present invention.

Said receiving frame 71, as shown in FIG. 9, has the base end pivotally secured to the case 10 and has a carrier strip turnback part 711 which turns back the carrier strip 81 of the label tape 80 at the tapered free end of the receiving frame 71.

Moreover, this receiving frame 71 is provided with support tongues 712 and 712' which support the label 82 separated from the carrier strip 81, guides 713 and 713' which control the movement in the widthwise direction of the label tape 82 and support pieces 714 and 714' which are engaged by said guide frame 73. The label 82 is supported at its lower center part by said support tongues 712 and 712' and the support pieces 714 and 714' are engaged by the guide frame 73 to cause the receiving frame 71 to be fixed in the case 10 as shown in FIG. 1, and the guide frame 73 is swung in the direction of the arrow so as to be disengaged from the receiving frame 71 to permit outward turning of the receiving frame 71 as shown by the broken line in FIG. 2.

Figure 11:
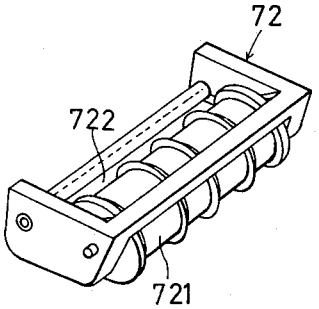
FIG. 11 is a perspective view of the holding member employed in said label separating mechanism.

Said holding member 72 is provided, as shown in FIGS. 2 and 11, with a label impression roller 721 and a holding part 722 which extends above said receiving frame 71.

This holding part 722 is engaged by the label 82 separated from the carrier strip 81 at its upper side and the label 82 is prevented from coming out of the labeler by this holding part 722 and the support tongues 712 and 712' on said receiving frame 71.

If the label 82 separated from the carrier strip 81 were connected to the following label only with an adhesive layer on the rear side of the label, such a label 82 would be unstably supported by the support tongues 712 and 712' only. If the label 82 is also supported at its upper side by the holding part 722 as shown in this embodiment, the label is prevented from counterclockwise movement in FIG. 2 and is held so that it does not come out of the labeler.

The label receiving surface 71' of said receiving frame 71 is made of a sheet member which has elasticity and is demountably fitted in a recess 716 formed in the upper surface of said receiving frame 71 as shown in FIG. 9. The sheet member 715 has a label receiving surface 71' which is smooth and a deformable rear surface 717.

This deformable rear surface 717 is made so that the label receiving surface 71' can be deformed by the type elements 541' of the printing mechanism 51. In the embodiment, two printing mechanisms 51 and 51' are provided and the sheet member 715 is provided with two deformable rear surface portions 717 and 717' which correspond to the positions of the printing mechanisms 51 and 51', respectively.

Figure 10:
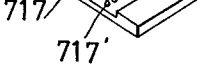
FIG. 10 is a rear view of the sheet member employed in said receiving frame.

This deformable rear surface 717, as shown in FIG. 10, is constructed so that the projections 718 which respectively receive the impression force of type elements 541 are provided at each part of the label receiving surface 71' which is contacted by the type elements 541 and they are arranged in arrays on the rear side of the label receiving surface 71'.

Figure 12:
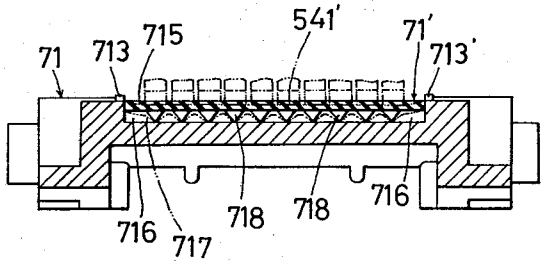
FIG. 12 is a magnified cross sectional front view of said receiving frame along line 10—10 in FIG. 9.

This porjections 718 are shaped in the form of a cone at the tip end. When the printing face of said printing mechanism 51 is impressed onto the label 82 on the label receiving surface 71', the projections 718 are deformed individually and independently, as shown by the broken lines in FIG. 12, by the impression force of each type element which forms the printing face of the printing mechanism, and a slight unevenness of the type elements 541 which form the printing face is absorbed by such independent deformation of the projections 718; thus clear and fine printing is carried out on the label.

Said checking device 90 serves to check the position of the lever 21, that is, the amount of movement when the lever 21 is pulled toward the handle 13. In the embodiment, the recess 212 which is open toward the handle 13 is formed in the lever 21 and a check signal generating part consisting of a buzzer 91, battery 92, and switch 93 is provided in said recess 212. Simultaneously, actuating means such as, for example, a contact piece 94 which actuates said switch 93 is provided in the recess 131 of the handle 13. When said lever 21 approaches the handle 13 to a specified distance, said switch 93 contacts the contact piece 94 and is actuated to cause the check signal to be generated or the buzzer 91 to sound. Accordingly, the labeler according to the present invention can provide a constant impression force of the printing mechanism on the label to be printed.

Figure 13:
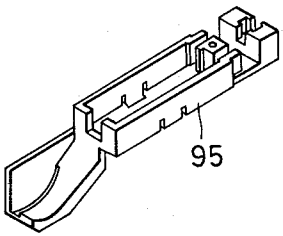
FIG. 13 is a perspective view of the casing employed in the checking device of the labeler of the present invention.

It is preferable to employ the casing 95 shown in FIG. 13 for said checking device 90. The buzzer 91, battery 92 and switch 93 are built in advance in this casing 95 to form a unit so that the casing 95 can be demountably fitted to the lever 21 to ensure convenience and ease of repair and replacement.

What is claimed is:

1. A manually-operated labeler for dispensing labels from a carrier strip onto which said labels are stuck, comprising:

a case having a carrier strip holder for holding a roll of carrier strip onto which a number of labels are stuck in order;

an actuating mechanism having an operating part which extends inside said case and is pivotally mounted in said case;

a feed drive mechanism provided on said operating part of the actuating mechanism;

a carrier strip feeding mechanism housed in said case and having a feed drum which engages with a carrier strip being unrolled from a roll of carrier strip, said feed drum being driven by said feed drive mechanism during movement thereof for feeding a fixed length of carrier strip when said carrier strip feeding mechanism is driven by said feed drive mechanism;

a carrier strip trunback part in said case around the edge of which the carrier strip is turned back by the feeding action of said feeding mechanism for separating a label stuck on said carrier strip;

a printing device mounted on said operating part for movement toward and away from said carrier strip turnback part and provided with a mounting frame which is pivoted to said operating part and contains at least one printing mechanism having type elements on the end of said printing device which is toward said carrier strip turnback part;

guide means operatively associated with said printing device for guiding said end of said printing device to said carrier strip turnback part along a path inside the arc along which said end would move if unguided; and an ink supplying device provided with an ink roller which is to be pressed against the type elements of said printing device and swingable in an opposite direction to the direction of the movement of said end of the printing device so as to cause the ink roller to roll along said type elements and then separate from the printing device when the printing device approaches the label to be printed;

whereby the distance which the ink roller moves in said labeler is shortened by the swinging of said ink roller and said printing device in opposite directions.

2. A manually-operated labeler in accordance with claim 1, further comprising a cover forming the front panel of said case, said ink roller being inside said cover, and said cover being pivoted to the case at the upper part thereof and opened by turning the cover.

3. A manually-operated labeler in accordance with claim 1, wherein said guide means comprises a pair of projection members provided on one of either the sides of said mounting frame or the internal walls of said case and channels provided on the other of either the sides of said mounting frame or the internal walls of said case, said projection members being slidable in said channels, and said channels extending toward the pivotal mounting of said operating part and having a shape for guiding said end of said printing device to said carrier strip turnback part along a path inside the arc along which said end would move if unguided.

4. A manually-operated labeler as claimed in claim 3 in which said channels are in the internal walls of said case.

5. A manually-operated labeler as claimed in claim 4 in which said channels are straight and are angled toward said pivotal mounting.

6. A manually-operated labeler as claimed in claim 3 in which said channels are straight and are angled toward said pivotal mounting.

* * * * *